US008406440B2

(12) United States Patent
Kidmose

(10) Patent No.: US 8,406,440 B2
(45) Date of Patent: Mar. 26, 2013

(54) HEARING AID AND METHOD OF OPERATING A HEARING AID

(75) Inventor: Preben Kidmose, Maalov (DK)

(73) Assignee: Widex A/S, Lynge (DK)

( * ) Notice: Subject to any disclaimer, the term of this patent is extended or adjusted under 35 U.S.C. 154(b) by 1315 days.

(21) Appl. No.: 12/105,005

(22) Filed: Apr. 17, 2008

(65) Prior Publication Data

US 2008/0260190 A1 Oct. 23, 2008

Related U.S. Application Data

(63) Continuation-in-part of application No. PCT/EP2005/055348, filed on Oct. 18, 2005.

(51) Int. Cl.
*H04R 25/00* (2006.01)

(52) U.S. Cl. ..... 381/314; 381/312; 381/60; 381/320; 381/316

(58) Field of Classification Search ..... None
See application file for complete search history.

(56) References Cited

U.S. PATENT DOCUMENTS

| | | | | |
|---|---|---|---|---|
| 4,204,260 | A * | 5/1980 | Nysen | 702/181 |
| 5,325,436 | A * | 6/1994 | Soli et al. | 381/313 |
| 5,386,475 | A * | 1/1995 | Birck et al. | 381/320 |
| 5,687,241 | A * | 11/1997 | Ludvigsen | 381/312 |
| 6,628,795 | B1 * | 9/2003 | Ludvigsen | 381/321 |
| 6,748,092 | B1 * | 6/2004 | Baekgaard | 381/313 |
| 6,862,359 | B2 | 3/2005 | Nordqvist et al. | |
| 2003/0112987 | A1 | 6/2003 | Nordqvist | |
| 2004/0015318 | A1 * | 1/2004 | Heller et al. | 702/127 |
| 2004/0066944 | A1 * | 4/2004 | Leenen et al. | 381/314 |
| 2004/0190739 | A1 | 9/2004 | Bachler | |
| 2004/0202333 | A1 * | 10/2004 | Csermak et al. | 381/60 |
| 2005/0089183 | A1 * | 4/2005 | Niederdrank et al. | 381/312 |

FOREIGN PATENT DOCUMENTS

| | | | |
|---|---|---|---|
| EP | 0335542 | A1 | 10/1989 |
| EP | 0732036 | A1 | 9/1996 |
| EP | 1367857 | A1 | 12/2003 |
| WO | WO9827787 | A1 | 6/1998 |
| WO | WO0154456 | A1 | 7/2001 |

OTHER PUBLICATIONS

"Description of MemoryMate/HA fitting. Data logging." 13th Danavox Symposium—Oct. 1988, pp. 392-393.

Cummings et al (1987) "Ambulatory testing of digital hearing aid algorithms", RESNA '87 Proceedings of the 10th Annual Conference on Rehabilitation Technology, Jun. 19-23, 1987, San Jose, California pp. 389-400.

* cited by examiner

*Primary Examiner* — Duc Nguyen
*Assistant Examiner* — Taunya McCarty
(74) *Attorney, Agent, or Firm* — Sughrue Mion, PLLC

(57) ABSTRACT

A hearing aid is provided which has at least one input transducer for providing an input signal, at least one signal processing channel receiving at least a portion of said input signal, a hearing aid processor for processing said portion of said input signal to produce at least one output signal, an output transducer responsive to said output signal, and a data logger receiving said portion of said input signal for logging of input signal data. The data logger comprises a characterization unit for characterising and logging parameters of the input signal data, and a memory unit for storing said parameters.

20 Claims, 4 Drawing Sheets

HEARING AID AND METHOD OF OPERATING A HEARING AID

RELATED APPLICATIONS

The present application is a continuation-in-part of application No. PCT/EP/2005/055348; filed on Oct. 18, 2005, in Denmark and published as WO2007045276, the contents of which are incorporated hereinto by reference.

BACKGROUND OF THE INVENTION

1. Field of the Invention

The present invention relates to hearing aids and to methods of operating hearing aids. The invention, more particularly relates to logging in a hearing aid of data pertaining to the acoustical environment.

2. Prior Art

A publication Cummings, K. L., & Hecox, K. E. (1987). "Ambulatory testing of digital hearing aid algorithms", RESNA '87 proceedings of the 10th Annual Conference on Rehabilitation Technology Jun. 19-23, 1987 San Jose Calif., 389-400, suggests a portable unit for serving as a prototype hearing aid for testing signal processing algorithms. For providing an acoustic description of the listening environment, maximal and minimal sound pressure levels are recorded each of a number of sampling epochs, the minimal value assumed to represent the background noise level and the maximal value assumed to represent the speech level. The data may be represented in histogram form. The processor reads switch toggling. The unit is designed to permit retrospectively correlating the statistics of the patient's decisions and the environmental acoustics.

A publication "Description of MemoryMate/HA fitting. Data logging." 13th Danavox Symposium October 1988, 392-393, explains a hearing aid with multiple program memories and with data logging for keeping track of how many times the wearer has selected a specific memory and the total time each memory has been used.

EP-B-335542 describes an auditory prosthesis having data logging capabilities. The memory may permit recording of environmentally selected events, such as selection of settings, parameters, or algorithms, where such selection is based on an automatic computation in response to the current sound environment of the wearer. In a preferred embodiment, the method of determining the values for each of the data logs entails counting time in large segments, of the order of two minutes (128 seconds). Duration of use of each setting is then stored in units of two minutes. In a modified embodiment, the datalogging may be implemented in a remote control unit. The hearing aid has an interface permitting sending datalogging information to a programmer.

EP-A-1367857 shows logging or recording input signal data of a hearing prosthesis in combination with values of algorithm parameters of a digital signal processing algorithm executed in the prosthesis. The input signal data may comprise the digital input signal itself or the digital input signal may be recorded in a data-reduced form. The input signal data may comprise spectral features and temporal features of the digital input signal. The input signal data may comprise statistical measures, such as long-term average spectra, peak and minimum spectra, average or peak instantaneous input sound pressure levels, amplitude distributions statistics etc., of the digital input signal. Input signal data may be intermediately recorded in a volatile storage device, e.g. a data RAM. The intermediate data may subsequently be stored in the persistent data space at a substantially more infrequent rate. In event-driven data logging, the input signal data and the values of the hearing prosthesis variable may be recorded before and after a relevant trigger-event. A flexible histogram module can map various types of numerical data to a histogram and store a set of histogram data.

U.S. Pat. No. 6,862,359 suggests obtaining real life sound recordings by passing a signal through an input signal path of a target hearing prosthesis.

WO-A-01/54456 suggests collecting statistical data characterising physical or psychological properties of environments in which use of a hearing aid is desired. Data to collect could include levels and spectral distributions of sound across time. The hearing aid may act as a data collector.

US-A-20040190739 relates to a method for recording information in a hearing device or in a recording unit. Acoustic signals may be recorded by the microphone. Statistical data, as e.g. the amplitude percentile, or general spatial or spectral level distribution, acoustic characteristics over an adjustable time interval, sound type distribution, and sound type adjustment distribution, may be stored. The user or the fitter can trigger logging manually.

EP-B-0732036 explains a processing circuit for a hearing aid, which circuit contains a control circuit for continuous determination of a percentile value of the input signal from a continuous analysis and evaluation of the frequency or amplitude distribution of the input signal.

Logging in a hearing aid of data about the acoustical environment is subject to severe constraints pertaining to size, memory capacity, processor capacity and power consumption.

Logging of data about the acoustical environment in a dedicated device, separate from the hearing aid, may easy the constraints but only comes against the penalty of not getting the true acoustic environment at the level of the hearing aid microphone, therefore being of less value with a view to providing data for permitting optimising the hearing aid settings.

The logging data will normally be available to a fitter who will transfer the logging data from the hearing aid during a fitting session. Normally, the fitter must initially program the hearing aid according to general fitting rules. The user will then start using the hearing aid, and he or she will in most cases later revert for a follow-up session, where he or she can discuss the initial experience and any desires for fine-tuning. The fitter can then advise and adjust as appropriate. A logging of data about the intrinsic behaviour of the hearing aid and about the acoustic environment would be a major advantage for understanding and investigating options for improving the programming, as well as for tracking any malfunctions in the hearing aid.

There is an interest for collecting a lot of data in order that the user can aggregate sufficient data for an early follow-up visit to the fitter, if necessary. This requires a high sampling rate in the logging. On the other hand, there is a desire for providing also long-time logging, e.g. logging for the entire service life of the hearing aid, a desire that is not compatible with a high sampling rate in the logging.

Thus, there is a need for improved hearing aids as well as improved techniques for logging of data pertaining to the acoustic environment.

SUMMARY OF THE INVENTION

It is therefore an object of the present invention to provide hearing aids and methods of operating hearing aids taking the mentioned requirements and drawbacks of the prior art into account.

According to a first aspect of the present invention, there is provided a hearing aid having an input transducer for providing an input signal, a hearing aid processor for processing said input signal to produce at least one output signal, an output transducer responsive to said output signal, and a data logger receiving said portion of said input signal for logging of input signal data, wherein said data logger comprises means for selecting a rate of logging, means for storing the selected rate of logging, and a characterisation unit for characterising and logging at least one of the following parameters of the sound environment:

at least one slope of the sound spectrum of said input signal data;

a modulation of said input signal data; and a sound pressure level of the noise of said input signal data.

The provided data logger enables to characterise and log parameters of the input signals. According to an embodiment of the present invention, the data logger characterises and logs two basic parameters: statistics of features that characterise the sound environment (so called histogram logging) and the time the user is using the different programs available in the hearing aid (so called usage logging).

The invention, in a second aspect, provides a hearing aid system comprising at least two hearing aids, each of said two hearing aids having an input transducer for providing an input signal, a hearing aid processor for processing said input signal to produce at least one output signal, an output transducer responsive to said output signal, and a data logger receiving said portion of said input signal for logging of input signal data, wherein said data logger comprises means for selecting a rate of logging, means for storing the selected rate of logging, and a characterisation unit for characterising and logging at least one of the following parameters of the sound environment:

at least one slope of the sound spectrum of said input signal data;

a modulation of said input signal data; and a sound pressure level of the noise of said input signal data, and fitted for use by a single user, wherein the load of logging is shared among said two hearing aids, and wherein said two hearing aids are adapted to operate in time synchronisation.

According to an embodiment, the logging of parameters comprising statistics of features characterising the sound environment and the time a user is using different programs available in said hearing aid.

The invention, in a third aspect, provides a A method of operating a hearing aid comprising: receiving an input signal and providing at least a portion of said input signal for further processing; processing at least said portion of said input signal to produce at least one output signal and outputting said output signal; selecting a rate of logging storing the selected rate of logging, and characterizing and logging at least one of the following parameters at least one slope of the sound spectrum of said input signal, a modulation of said input signal, and a sound pressure level of the noise of said input signal.

The invention, in a fourth aspect, provides a computer program comprising executable program code which, when executed on a computer, executes a method according to a method of operating a hearing aid comprising: receiving an input signal and providing at least a portion of said input signal for further processing; processing at least said portion of said input signal to produce at least one output signal and outputting said output signal; selecting a rate of logging; storing the selected rate of logging, and characterizing and logging at least one of the following parameters at least one slope of the sound spectrum of said input signal, a modulation of said input signal, and a sound pressure level of the noise of said input signal.

Further specific variations of the invention are defined by the further dependent claims.

Other aspects and advantages of the present invention will become more apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Figure 1:
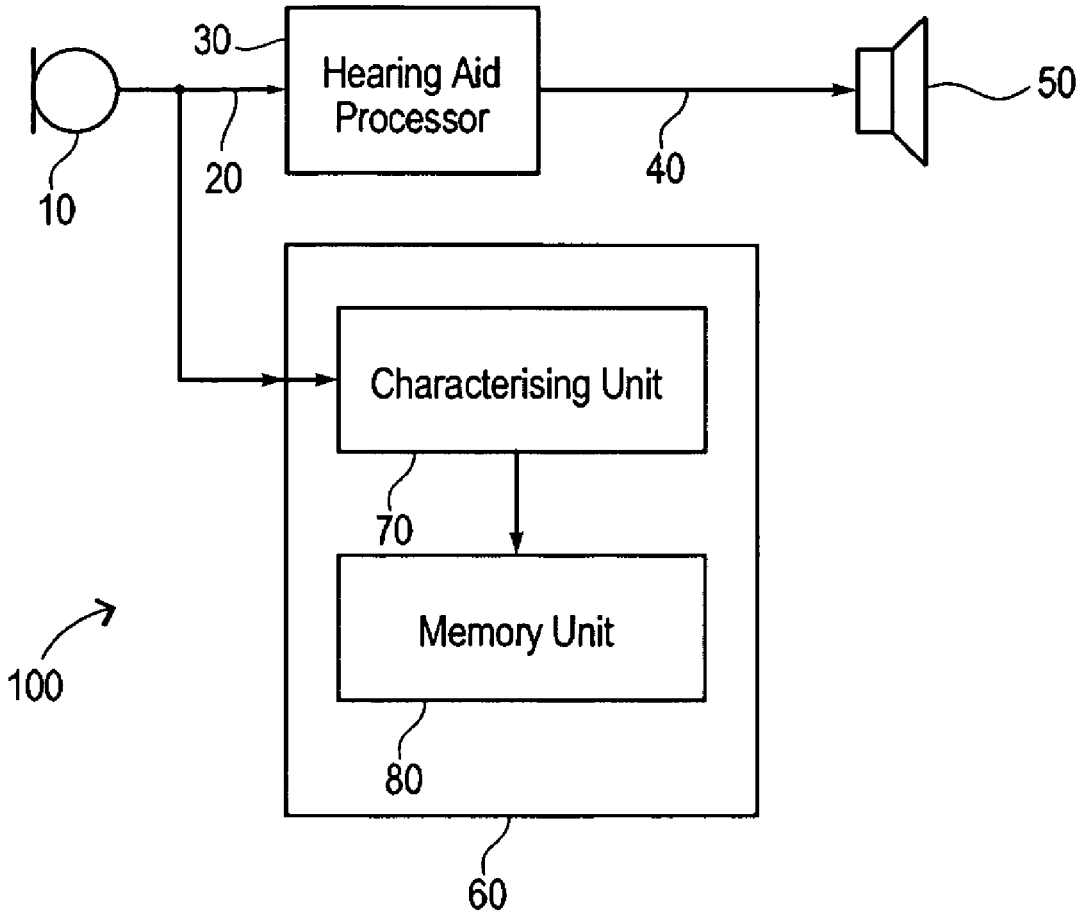
FIG. 1 is a schematic block diagram of a hearing aid according to a first embodiment of the present invention.

FIG. 1 shows a hearing aid 100 with at least one input transducer 10 which provides an input signal, at least one signal processing channel 20 that receives at least a portion of the input signal, a hearing aid processor 30 that processes the portion of the input signal to produce at least one output signal 40, an output transducer 50 which is responsive to the output signal, and a data logger 60 that receives the portion of the input signal and logs the data of the portion of the input signal. The data logger comprises a characterisation unit 70 that characterises and logs parameters of the input signal data, and further comprises a memory unit 80 that stores these parameters.

As illustrated in FIG. 1, the data logger 60 receives the input signal from the transducer or microphone before the input signal has been subject to any significant shaping by, e.g., the hearing aid processor 30.

Figure 2:
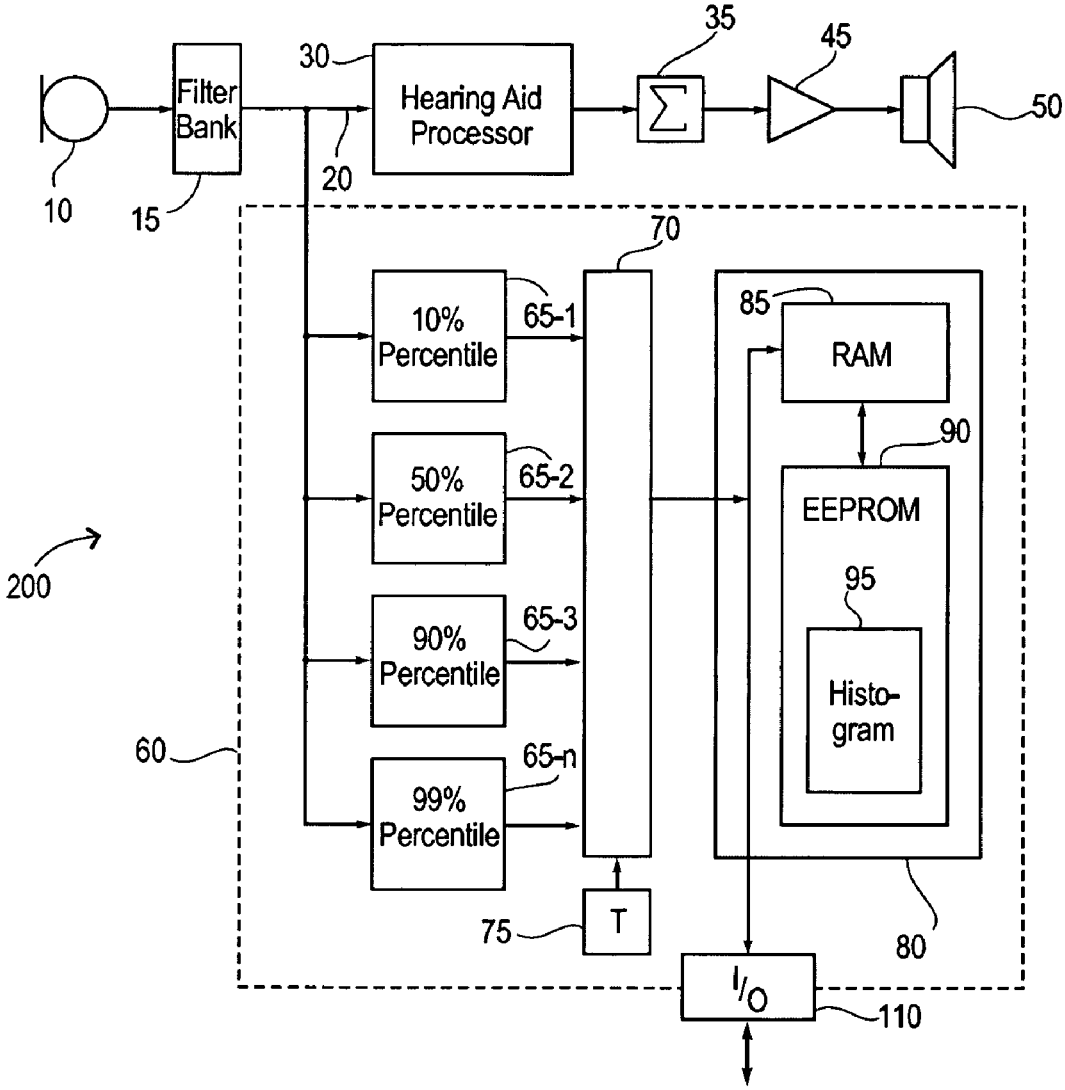
FIG. 2 is a schematic block diagram of a hearing aid according to a second embodiment of the present invention.

FIG. 2 shows a hearing aid 200 according to a second embodiment of the present invention in which the input signal of the input transducer 10 is received by a filter bank 15 which separates the input signal in, e.g., 15 frequency bands. This means that the output of the filter bank in the following signal processing channel for the hearing aid processor 30 as well as the data logger 60 is processed in 15 different frequency bands. The output signals output from the hearing aid processor are then further processed in summation circuit 35, an output amplifier 45 and the output transducer 50.

According to an embodiment, the data logger 60 of hearing aid 200 comprises a timer or trigger unit 75 so that logging may be timed. Logging may also be triggered by an event, such as the pressing of a button (not shown) by the hearing aid user, reaching a particular state in the processing in the hearing aid, or a particular state in the acoustic environment.

According to another embodiment, the data logged in the memory unit 80 of the hearing aid will be read out as part of a fitting session via an interface unit 110 by relying on a programming interface, e.g. the industry standard NOAH-Link interface.

According to an embodiment of the present invention, the memory unit 80 of hearing aid 200 comprises a volatile memory, e.g. a RAM 85 and a non-volatile memory, e.g. an EEPROM 90. The logging rate should be set appropriately to economise memory capacity and EEPROM usage. A trade-off should be found between early gathering of sufficient data and avoiding breaking the limits on EEPROM writings. According to an embodiment, a frequent sampling of the data logger 60 is provided, e.g. every second, in the early phases, and then the rate is lowered in subsequent stages, e.g. to once every 4 minutes. This would fit well with normal usage of the hearing aid, where the user can be expected to come back frequently in the early phases for fine-tuning of the hearing aid, and then later on only with longer intervals. A so called gear shifting could be automatic, i.e. triggered whenever one count has reached 255. Obviously, there must be a capacity for keeping a record of the gear-shiftings.

Embodiments Utilizing Binaural Memory

Logging requires substantial memory capacity in order to keep a detailed record, in particular for logging of sound environments. As the sound environment at the two ears of the user is substantially the same, this could in the case of a binaural fit (the user has hearings aids for both ears) be exploited in the way that the load of logging was shared among the hearing aids, e.g. each hearing aid logging a specific category of input signal data, which data would later be transferred to, e.g., a computer, which would analyse them in concert. According to an embodiment, the analysis software could be implemented as part of the fitting software.

Binaural logging in combination with a time synchronisation among the hearing aids will permit the recording of data about the spatial sound environment. According to an embodiment, in the case the user has two hearing aids, a hearing aid device comprises these two hearing aids and logs the parameters of the sound environment represented by the input signal data of the input transducers of both hearing aids in synchronism and distributes the storing of the data to the memory units of both hearing aids.

Embodiments Utilizing Histogram Logging

Histogram logging comprises the logging of three parameters, which characterise the sound environment:

1) The slope of the sound spectrum
2) The modulation
3) The sound pressure level of the noise Ad 1—Embodiments Utilising the Slope of the Sound Spectrum The slope of the sound spectrum is estimated by taking a particular percentile in each of the frequency bands. The slope is obtained by a least squares fit of a line to the sound spectrum; this is a very coarse 1-dimensional parameterisation of the sound spectrum. The purpose of the slope is to characterise whether the sound is dominated by low-frequency components or by high frequency components. The slope is expressed in the unit [dB/band].

According to an embodiment, the slope-feature is based on a 10%, 50%, 90% or 99% percentile provided by respective percentile estimators 65-1, 65-2, 65-3, . . . , **65-*n* of data logger 60. Each percentile estimator receives the spectrum of input signal data and outputs its respective percentile spectrum to the characterisation unit 70** for further processing to determine the slope. An example of a percentile estimator which could be used according to an embodiment of the present invention is disclosed in WO 98/27787.

Figure 3:
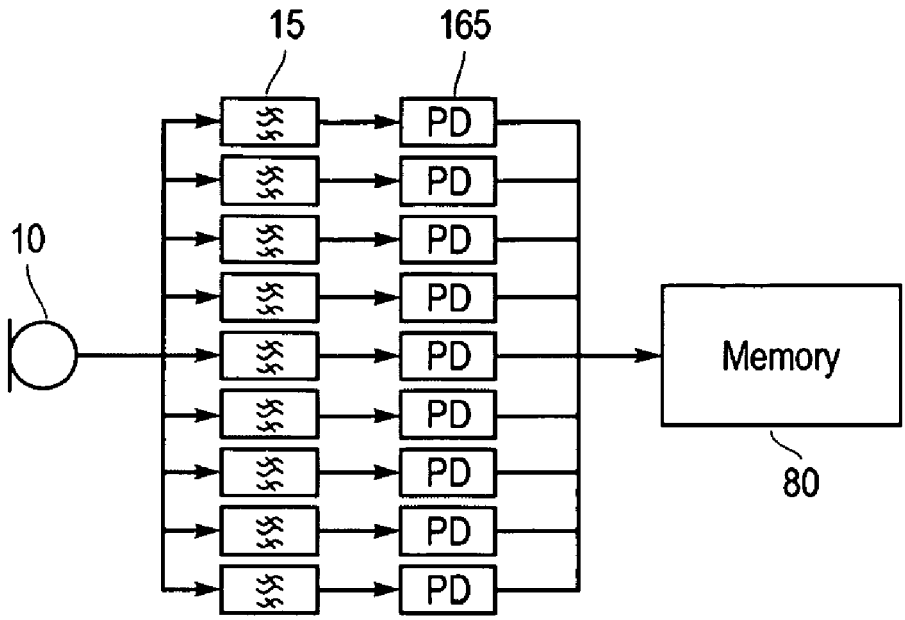
FIG. 3 is a schematic block diagram of a part of a hearing aid according to an embodiment of the present invention.

A block diagram schematically showing the analysis of incoming sound according to another embodiment is illustrated in FIG. 3. The sound from one or more input transducers 10 are analysed in the filter bank 15. The output of each filter is then further analysed in percentile detectors 165 using non-parametric statistics in order to determine the distribution function of the levels in that particular frequency region. The results are sampled by characterisation unit 70 (not shown in FIG. 3) and stored in the memory unit 80.

Figure 4:
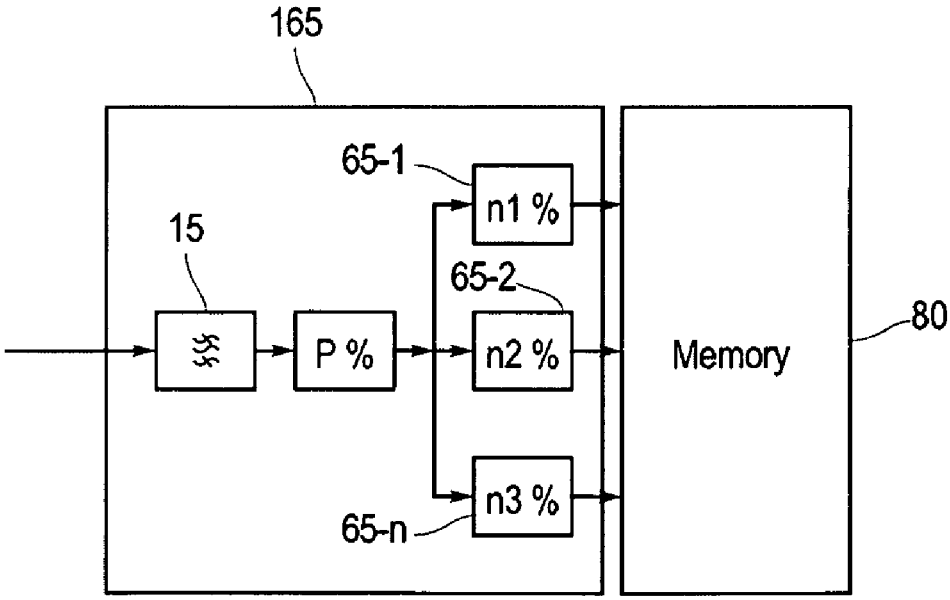
FIG. 4 is a more detailed schematic block diagram of the percentile detector depicted in FIG. 3 according to an embodiment of the present invention.

In FIG. 4, it is shown for one of the band pass filtered signals how percentile estimators of percentile detector 165 are used to describe the level distribution function. For a particular frequency band it is shown how a number of different percentile estimators 65-1, 65-2, . . . , **65-*n* are utilized to describe the level distribution of the band pass filtered signal, and at regular or irregular intervals store these data in a memory 80**. By using only a high and a low percentile, the dynamic range or modulation (see also below) of the input signal in this particular band can be estimated, and, by using the estimated values in respect of a certain percentile across different bands, the slope of the spectrum can be estimated.

Figure 5:
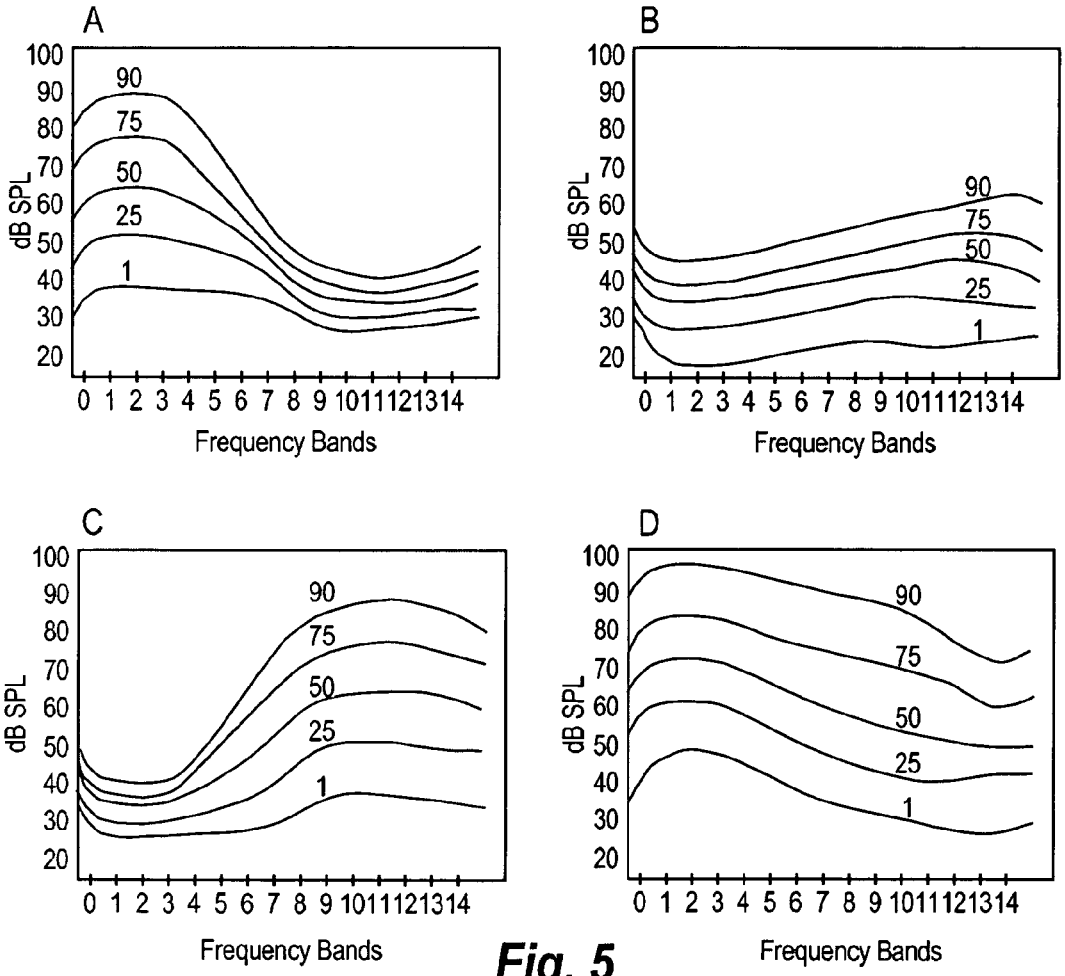
FIG. 5 depicts examples of hypothetical sound environment profiles for four hearing aid users taken by percentile estimators over the frequency range of the input signal.

Examples of hypothetical sound environment profiles for four hearing aid users A, B, C, and D taken by percentile estimators based on 1%, 25%, 50% 75% and 99% percentile in each of the frequency bands are depicted in FIG. 5. A sound environment profile will inevitably to some extent depend on the logged time window chosen. If the window length is long, several different listening situations may contribute to the profile. It should be further taken in consideration that the maximal window duration corresponds to the entire period of time in which the hearing aid has been in use. It is possible to limit the duration of the logging in order to prevent more than one listening situation to contribute to the profile. The selection of the logging duration can be determined by the audiologist, the fitting program, or by the user, e.g. by means of a remote control or a special programming unit.

According to an embodiment, the data logger provides calculating the slope based on different percentiles as illustrated in FIG. 2. Calculating the 10% percentile spectrum extracts information on the background noise spectrum. Calculating the slope based on the 50% percentile spectrum extracts information on the average sound pressure spectrum. Calculating the slope based on the 90% or 99% percentile spectrum extracts information on the most dominating sound sources.

According to another embodiment, the percentile spectrum is based on different spatial characteristics, i.e. the spectrum can be based on an omni-directional, a fixed directional characteristic, or an adaptive characteristic. If the percentile spectrum is based on an omni-directional characteristic all sound sources are contributing equally to the percentile spectrum; whereas if the percentile spectrum is based on a fixed cardiod-response, the spectrum will primarily extract information on sounds from sound sources that are located in front of the hearing-aid-user.

In a histogram logging according to a particular embodiment of the present invention, the intervals of the histogram are chosen as follows:

Slope intervals: Provision of three classes, e.g. below −1.5 dB/band; between −1.5 dB/band and −0.5 dB/band; and above −0.5 dB/band. The intervals should be adapted to the actual filter bank, and these values have been found appropriate for an approximately ⅓ octave filter bank. These intervals have been empirically chosen.

Ad 2—Embodiments Utilising the Modulation

The modulation is an approximation to the well-known Hilbert-transform of the signal, and is estimated by taking the difference (in dB) between a low (e.g., according to an embodiment, approximately 10% percentile) and a high (e.g., according to an embodiment, approximately 90% percentile) percentile. The purpose of the modulation is to characterise the dynamical range in the sound environment. Stationary environments like sitting in a quiet living room or driving a car on the highway are example on environments that have low modulation. Medium modulation is typical for most kind of music, cocktail party situations and office environment. Examples of environments with high modulation are speech in quiet and impulsive sounds like hammering. The modulation is expressed in the unit [dB]. Natural fluent speech has been found to exhibit a modulation of approximately 28 dB.

For providing current histogram analysis, the modulation determined by the characterisation unit 70 is referred to one of four classes, and for any given time sample analysis, a respective one among four counters will be incremented by one. The counters are implemented in the RAM 85 or in the EEPROM 90. In a histogram logging according to a particular embodiment of the present invention, the intervals of the histogram are chosen empirically as follows:

Modulation: Four classes, e.g. below 5 dB; between 5 dB and 10 dB; between 10 dB and 20 dB; and above 20 dB.

Ad 3—Embodiments Utilising the Sound Pressure Level of the Noise

The sound pressure level of the noise is estimated as a low (e.g., according to an embodiment, 10% percentile) percentile of the broadband signal. The sound pressure of the noise is expressed in the unit [dB].

For providing current histogram analysis by the data logger, the sound pressure level of the noise found is referred to one of four classes, and for any given time sample analysis, a respective one among four counters will be incremented by one.

In a histogram logging according to a particular embodiment of the present invention, the intervals of the histogram are chosen empirically as follows:

Sound pressure of noise level: Four classes, e.g. below 30 dB; between 30 and 40 dB; between 40 and 50 dB; above 50 dB.

The histogram logging stored in memory 90 records a statistical summary of the three features; thus the joint frequency of the features are logged in a 3-dimensional histogram 95. A histogram is defined by the observation intervals, i.e. every observation is assigned to an interval and the counter for that interval is incremented with one. Thus each bin in the histogram is a counter that reflects the number of observations that are categorised to that specific interval. The memory requirement for a histogram is determined by the number of intervals multiplied with the number of bits assigned to each bin (interval counter). In order to reduce the memory requirements, the data logger 60 has, e.g., a coarse quantisation of the 3 parameters resulting in a total of 48 histogram bins (3 levels of the slope, 4 levels of the modulation, and 4 levels of the sound pressure level).

According the a particular embodiment, the data logger 60 may operate partly as shown in FIG. 1 and partly as shown in FIG. 2. In a situation the data logger operates as a slope detector, it receives the output of the filter bank 15 as band split input signal whereas in a situation the data logger operates as a modulation detector or noise sound pressure level detector it receives the portion of the input signal provided by the input transducer 10 as input signal.

According to an embodiment, the histogram 95 is built up in the volatile memory (RAM) 85, and then written to the non-volatile memory (EEPROM) 90 with a slower update rate. In order to reduce the memory requirements in EEPROM there may be provided a logarithmic mapping from the RAM-registers to the EEPROM-registers. The logarithmic mapping may include a quantisation, and thus a lower number of bits for each histogram-bin is required in the EEPROM 90. According to this embodiment, when the histogram values are loaded from EEPROM to RAM there is provided an inverse (exponential) mapping.

According to another embodiment, the update time-interval of the histogram 95 is logarithmic over time. Whenever one of the histogram counters in memory 85 reach the maximum value, e.g. 255 in case of 8-bit counters, the logging interval is doubled, and all the histogram counters are right-shifted by one (corresponding to multiplication by 0.5). This results in a dynamic histogram that always reflects the complete logging time, where all counts (observations) in the histogram reflect the same time interval, and where the complete dynamic range of the counters in the histogram is exploited. In order to continue the histogram logging after reading the histogram values from EEPROM, and in order to make the right interpretation of the histogram, the logging interval is stored in memory along with the histogram counters.

The histogram logging is intended for logging in a predetermined maximum time period. A simple method to limit the overall logging time period is by limiting the maximum logging interval. Thereby there is a limit for the number of EEPROM-writings. Whenever the maximum logging interval has been reached, the Histogram Logging will be disabled.

The histogram logging may, in one embodiment, be operated in four different modes:

Accumulate-Mode

The histogram logging is started by a dispenser. The histogram logging will accumulate the histogram until it reaches its maximum logging interval, or it is stopped by the dispenser.

Event Driven Mode, Reset

The histogram logging is triggered by a user-evoked event (press button on the remote-control). Whenever a new event occurs, the histogram will reset and build up a new histogram over a predetermined time period (60 sec.). After the predetermined time period it will wait for a new event.

Event Driven Mode, Accumulate

The histogram logging is triggered by a user-evoked event (press button on the remote-control). The histogram will accumulate in a predetermined time period, and there after it will wait for a new event.

Event Driven Mode, Start/Stop

The histogram logging is triggered by a user-evoked event (press button on the remote-control). Whenever a new event occurs, the histogram will toggle between start and stop. Transition from stop to start the histogram logging will simply continue to accumulate the histogram. Transition from start to stop the histogram will simply stop the histogram logging, and let it wait for a new event.

Embodiments Utilizing Usage Logging

The usage logging comprises logging the time the user is using each of the different programs available in the hearing aid. In one embodiment, the usage logging can log the time for 5 different programs, i.e. it uses five bin counters.

In another embodiment, the bin counts are mapped into logarithmic bin counts, in order to expand the counting range, against the cost of lowering the resolution.

Data are recorded in an EEPROM in memory unit 80. According to the manufacturers specifications, the EEPROM is rated to last for a finite number of write-cycles (e.g. 500 000 write-cycles) to each address. The data logger may therefore be adapted to use this capacity sparingly in order to ensure that it will be functional over the lifetime of the hearing aid. In general, this may be achieved by logarithmic mapping, gear shifting of the sampling rate or real time analysis to extract condensed data for storage.

According to an embodiment, the usage logging and the histogram logging may be enabled or disabled individually by a procedure integrated with a fitting procedure.

According to another embodiment, the usage logging may be enabled during the whole life-time of the hearing aid, whereas the histogram logging will automatically time-out after a predetermined time-period.

The usage logging interval, in one embodiment, is constant, but may be adjusted according to desired time-resolution. In order to ensure that the maximum number of EEPROM write-cycles is not exceeded, the usage logging keeps track of how many write-cycles there have been to each EEPROM-memory address. If a predetermined upper limit has been reached for one specific memory address, the complete usage logging is disabled.

Embodiments Utilising Non-Volatile Memory Management

In one embodiment (not shown), the data logger 60 is adapted to store results in non-volatile memory (EEPROM) 95. The process of writing data on the fly to the EEPROM must be carefully managed to avoid the risk of a data loss, which may occur for a number of reasons. The most likely form of data-corruption is corruption of a complete memory-bank (the EEPROM are organised in 48-bit banks).

To obtain a reliable and robust management of the non-volatile memory all EEPROM-banks that are writeable for the data logging-block are equipped with CRC's ({C}yclic {R}edundancy {C}ode). The CRC provides a validity-check for data in each memory-bank.

CRC's provides error-detection but not error-correction. Since the most likely form of data corruption is a complete memory-bank corruption, an error-correcting code operated bank-wise would not provide any additional robustness. Thus the CRC only provides a validity-check, but no way to reconstruct the corrupted data.

To obtain robustness against corruption of a complete memory-bank part of the data are stored redundantly in different memory-banks according to an embodiment of the present invention. The memory management takes care of never writing data to a memory-bank without ensuring that the redundant memory banks are valid.

This provides a reliable but memory expensive management of the EEPROM-banks that are writeable for the data logging-block. Due to limited memory space part of the logging data or parameter are not stored redundant; these data cannot be restored in case of data corruption, and for these data there is a suitable error-handling. In a preferred embodiment, these data are the histogram logging data being considered less important. In other situations and embodiments, these data might be part of the usage logging data.

All appropriate combinations of features described above are to be considered as belonging to the invention, even if they have not been explicitly described in their combination.

Hearing aids, methods and devices according to embodiments of the present invention may be implemented in any suitable digital signal processing system. The hearing aids, methods and devices may be used by, e.g., the audiologist in a fitting session. Methods according to the present invention may also be implemented in a computer program containing executable program code executing methods according to embodiments described herein. If a client-server-environment is used, an embodiment of the present invention comprises a remote server computer which embodies a system according to the present invention and hosts the computer program executing methods according to the present invention. According to another embodiment, a computer program product like a computer readable storage medium, for example, a floppy disk, a memory stick, a CD-ROM, a DVD, a flash memory, or any other suitable storage medium, is provided for storing the computer program according to the present invention.

According to a further embodiment, the program code may be stored in a memory of a digital hearing device or a computer memory and executed by the hearing aid device itself or a processing unit like a CPU thereof or by any other suitable processor or a computer executing a method according to the described embodiments.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

I claim:

1. A hearing aid having an input transducer for providing an input signal, a hearing aid processor for processing said input signal to produce at least one output signal, an output transducer responsive to said output signal, and a data logger receiving said portion of said input signal for logging of input signal data, wherein said data logger comprises means for selecting a rate of logging, means for storing the selected rate of logging, and a characterisation unit for characterising and logging at least one of the following parameters of the sound environment:

at least one slope of the sound spectrum of said input signal data;

a modulation of said input signal data; and a sound pressure level of the noise of said input signal data;

wherein said data logger comprises a trigger unit adapted to provide an automatic modification of the logging rate by lowering said logging rate in response to a predetermined count of logging activity.

2. The hearing aid according to claim 1, comprising a memory unit for storing said logged parameters, wherein said logged parameters include statistics of features characterising the sound environment stored as histogram logging values, or the time the hearing aid user is using different programs available in the hearing aid.

3. The hearing aid according to claim 1, comprising:

a filter bank for dividing said input signal into a plurality of frequency bands; and wherein said data logger logs said input signal data in at least one of said frequency bands.

4. The hearing aid according to claim 1, comprising:

at least one percentile estimator for providing at least one of a 10%, 50%, 90%, or 99% percentile for said input signal data or in at least one of said frequency bands.

5. The hearing aid according to claim 4, wherein said characterisation unit is adapted to estimate a particular slope of the sound spectrum by determining a least square fit of a line of a particular percentile in at least one of said frequency bands.

6. The hearing aid according to claim 1, wherein said characterisation unit is adapted to determine said modulation by determining the dynamic range of said input signal data.

7. The hearing aid according to claim 6, wherein said characterisation unit is adapted to determine said dynamic range by taking the difference between a low and a high percentile of said input signal data.

8. The hearing aid according to claim 1, wherein said characterisation unit is adapted to determine said sound pressure level of the noise of said input signal data by determining a low percentile of said input signal data.

9. The hearing aid according to claim 1, wherein said data logger logs said parameters in a N-dimensional histogram, wherein N is the number of logged parameters, and wherein said histogram provides a plurality of bins, each bin comprising a counter reflecting the number of logs in the respective bin.

10. The hearing aid according to claim 1, wherein said data logger further comprises a timer unit, and said timer unit being adapted to provide an automatic modification of the logging rate by lowering said logging rate after a particular time interval.

11. The hearing aid according to claim 9, wherein said trigger unit triggers lowering of said logging rate whenever one of said counters has reached a particular value.

12. The hearing aid according to claim 9, wherein said histogram is stored in a memory unit which comprises a volatile memory for building up said histogram, and further comprises a non-volatile memory to which said histogram is written with a slower update rate.

13. The hearing aid according to claim 12, wherein said trigger unit is adapted to trigger said histogram logging by a user-evoked event, wherein said trigger unit is adapted to reset the histogram whenever said event occurs and said data logger is adapted to build up a new histogram over a predetermined time period.

14. The hearing aid according to claim 1, wherein said memory unit provides an EEPROM as a non-volatile memory for storing said logged parameters, wherein said data logger is adapted to write said parameters to said EEPROM by using logarithmic mapping, lowering the sampling rate in subsequent stages, and real time analysis to extract condensed data for storage.

15. The hearing aid according to claim 1, comprising an interface for individually enabling or disabling said logging of said histogram logging values or said usage logging values by a fitting procedure.

16. The hearing aid according to claim 1, wherein said characterisation unit is adapted to characterise and log said parameters depending on the spatial characteristic of said input signal data.

17. A hearing aid system comprising at least two hearing aids fitted for use by a single user, each of said hearing aids having an input transducer for providing an input signal, a hearing aid processor for processing said input signal to produce at least one output signal, an output transducer responsive to said output signal, and a data logger receiving a portion of said input signal for logging of input signal data, wherein said data logger comprises means for selecting a rate of logging, means for storing the selected rate of logging, and a characterisation unit for characterising and logging at least one of the following parameters of the sound environment:

at least one slope of the sound spectrum of said input signal data;

a modulation of said input signal data; and a sound pressure level of the noise of said input signal data;

wherein the load of logging is shared among said two hearing aids, and wherein said two hearing aids are adapted to perform data logging in time synchronisation.

18. A method of operating a hearing aid comprising:

receiving an input signal and providing at least a portion of said input signal for further processing;

processing at least said portion of said input signal to produce at least one output signal and outputting said output signal;

selecting a rate of logging storing the selected rate of logging, and characterizing and logging at least one of the following parameters at least one slope of the sound spectrum of said input signal, a modulation of said input signal, and a sound pressure level of the noise of said input signal, wherein said step of selecting a rate of logging comprises automatically lowering said logging rate in response to a predetermined count of logging activity.

19. The method according to claim 18, comprising the step of reading out said parameters as part of a fitting session by using a programming interface of said hearing aid.

20. A computer program in a non-transitory computer readable medium, said program comprising executable program code which, when executed on a computer, executes a method of operating a hearing aid comprising:

receiving an input signal and providing at least a portion of said input signal for further processing;

processing at least said portion of said input signal to produce at least one output signal and outputting said output signal;

selecting a rate of logging storing the selected rate of logging, and characterizing and logging at least one of the following parameters at least one slope of the sound spectrum of said input signal, a modulation of said input signal, and a sound pressure level of the noise of said input signal, wherein said step of selecting a rate of logging comprises automatically lowering said logging rate in response to a predetermined count of logging activity.

* * * * *